US011065631B2

(12) United States Patent
Bennani et al.

(10) Patent No.: US 11,065,631 B2
(45) Date of Patent: Jul. 20, 2021

(54) SPRAYING NOZZLE WITH PRE-ATOMIZATION NARROWING, AND SPRAYING HEAD AND SPRAYING DEVICE COMPRISING SUCH A NOZZLE

(71) Applicant: EXEL INDUSTRIES, Epernay (FR)

(72) Inventors: Tarik Bennani, Paris (FR); Thibault Cognon, Paris (FR)

(73) Assignee: EXEL INDUSTRIES, Epernay (FR)

( * ) Notice: Subject to any disclaimer, the term of this patent is extended or adjusted under 35 U.S.C. 154(b) by 88 days.

(21) Appl. No.: 16/181,331

(22) Filed: Nov. 5, 2018

(65) Prior Publication Data

US 2019/0151870 A1 May 23, 2019

(30) Foreign Application Priority Data

Nov. 7, 2017 (FR) ..... 1760419

(51) Int. Cl.

| | |
|---|---|
| ***B05B 7/08*** | (2006.01) |
| ***B05B 7/24*** | (2006.01) |
| ***B05B 7/00*** | (2006.01) |
| ***B05B 7/06*** | (2006.01) |
| ***B05B 1/04*** | (2006.01) |
| ***B05B 7/04*** | (2006.01) |
| *B05B 9/04* | (2006.01) |

(52) U.S. Cl.

CPC ..... *B05B 7/0815* (2013.01); *B05B 1/04* (2013.01); *B05B 7/0012* (2013.01); *B05B 7/0483* (2013.01); *B05B 7/062* (2013.01); *B05B 7/2464* (2013.01); *B05B 7/2489* (2013.01); *B05B 9/0403* (2013.01)

(58) Field of Classification Search

CPC ..... B05B 7/0815; B05B 1/04; B05B 7/0012; B05B 7/0483; B05B 7/062; B05B 7/2464; B05B 7/2489; B05B 9/0403

USPC ..... 239/526, 590

See application file for complete search history.

(56) References Cited

U.S. PATENT DOCUMENTS

| | | | | |
|---|---|---|---|---|
| 25,372 A * | 9/1859 | Sollidday | B05B 1/00 239/590 |
| 2,569,251 A * | 9/1951 | Nieburg | B05B 7/0491 239/8 |
| 3,709,433 A * | 1/1973 | Obergefell | B05B 7/0012 239/8 |

(Continued)

FOREIGN PATENT DOCUMENTS

| | | |
|---|---|---|
| EP | 0392553 A1 | 10/1990 |
| FR | 2234746 A5 | 1/1975 |

OTHER PUBLICATIONS

French Patent Application No. 1760419, INPI Rapport de Recherche Préliminaire, dated Jun. 27, 2018, 3 pages.

*Primary Examiner* — Christopher S Kim

(74) *Attorney, Agent, or Firm* — Soquel Group LLC

(57) ABSTRACT

A spraying nozzle, intended for spraying a product, defines a passage for the circulation of the product through the nozzle, wherein the passage opens through a wide connection orifice to the outside of the nozzle at an upstream end thereof, and through a narrow spraying orifice at a downstream end of the nozzle in order to spray the product; the passage has, between the connection orifice and the spraying orifice, at least one pre-atomization narrowing capable of atomizing the product, followed by a broadening downstream of the pre-atomization narrowing.

12 Claims, 4 Drawing Sheets

(56) References Cited

U.S. PATENT DOCUMENTS

| | | | | |
|---|---|---|---|---|
| 4,925,101 | A * | 5/1990 | Konieczynski | B05B 7/1272 239/8 |
| 5,152,460 | A * | 10/1992 | Barty | B05B 7/0081 239/290 |
| 5,170,941 | A | 12/1992 | Morita et al. | |
| 5,615,836 | A | 4/1997 | Graef | |
| 5,829,682 | A | 11/1998 | Haruch | |
| 6,267,301 | B1 | 7/2001 | Haruch | |
| 7,163,163 | B2 * | 1/2007 | Waddelow | B05B 1/042 239/597 |
| 2004/0046040 | A1 | 3/2004 | Micheli | |
| 2012/0097765 | A1 | 4/2012 | Drozd et al. | |

* cited by examiner

SPRAYING NOZZLE WITH PRE-ATOMIZATION NARROWING, AND SPRAYING HEAD AND SPRAYING DEVICE COMPRISING SUCH A NOZZLE

CROSS REFERENCE TO RELATED APPLICATIONS

This application claims priority under 35 USC § 119 of French Patent Application No. 17 60419 filed on Nov. 7, 2017.

FIELD OF THE INVENTION

The present invention relates to a spraying nozzle for spraying a product, wherein it is of the type that defines a passage for the circulation of the product through the nozzle, wherein the passage emerges outside the nozzle at an upstream end thereof through a wide connection orifice, and at a downstream end of the nozzle through a narrow spraying orifice that is suitable for spraying the product.

The invention also relates to a spraying head for a product spraying device, of the type comprising an annular ring having a central orifice, and a spraying nozzle of the aforementioned type housed in the central orifice that is substantially coaxial with the annular ring.

The invention further relates to a spraying installation of the type comprising a source of the product to be sprayed and a spraying head of the aforementioned type, wherein the source of the product to be sprayed is fluidly connected to the connection orifice of the spraying nozzle.

The invention finally relates to a method of spraying a coating product, of the type comprising:

- supplying a spraying nozzle of the aforementioned type with the coating product via its connection orifice,
- first spraying of the coating product during the passage of the coating product through the pre-atomization narrowing, and
- second spraying of the coating product during the passage of the coating product through the spraying orifice.

BACKGROUND OF THE INVENTION

Spraying installations of the aforementioned type are known. They are intended to ensure the bursting of the coating product into fine droplets in order to coat a large surface with a small amount of product. For this purpose, the coating product is supplied under pressure from a source and fed under pressure to a spraying nozzle.

Several competing solutions exist to perform this spraying.

First of all there is pneumatic spraying. According to this solution, the coating product is supplied from the source under overpressure with respect to very low atmospheric pressure, typically between 0.5 and 1.5 bar. Compressed air is blown towards the outlet of the nozzle and it is this compressed air that atomizes the liquid film ejected by the nozzle. This solution has the advantage of providing a very high quality finish. It is also relatively cheap. However, it has the disadvantage of having a low transfer rate, wherein a large amount of the coating product is dispersed in the environment without reaching the surface to be coated.

Another solution consists of airless spraying. According to this solution, the coating product is supplied from the source under very high pressure, typically at a pressure between 160 and 300 bar. It is then the narrowness of the spraying orifice that causes the product to burst. There is no air involved. This solution has the advantage of an excellent transfer rate. However, it has the disadvantage of requiring pumping equipment capable of providing the coating product at very high pressure, and involves a very large consumption of compressed air to supply these pumps. This makes it an expensive technology.

A final solution is a mixed spray. According to this technology, the coating product is supplied from the high pressure source, typically at a pressure of between 50 and 150 bar. As in the case of airless spraying, it is the narrowness of the spraying orifice that causes the product to burst. This spraying is, however, not optimal, given the relatively low pressure at which the coating product is supplied from the source. To improve the atomization of the product, compressed air is blown to the outlet of the nozzle, as in the case of pneumatic spraying technology. This solution makes it possible to obtain the substantially same quality of finish as with airless spraying but with a good transfer rate, while it is more economical since the coating product is supplied at a lower pressure. However, it has the disadvantage of remaining relatively expensive compared to the pneumatic spraying solution.

SUMMARY OF THE DESCRIPTION

It is an object of the invention to reduce the pressure at which the coating product is to be provided when working with airless spraying or mixed spraying, while maintaining the transfer rates and finishing qualities usually obtained with these technologies.

For this purpose, the object of the invention is a spraying nozzle of the aforementioned type, wherein the passage between the connection orifice and the spraying orifice comprises at least one pre-atomization narrowing that is able to atomize the product, followed by a broadening downstream of the pre-atomization narrowing.

According to particular embodiments of the invention, the spraying nozzle also has one or more of the following characteristics, taken separately or in any technically feasible combination:

- the spraying nozzle comprises a tubular body oriented in an axial direction and internally defining a through-duct that opens in a first axial end of the body through a first opening constituting the connection orifice, while the spraying nozzle further comprises a pre-atomization insert that is housed in the through-duct and defines the pre-atomization narrowing;
- the pre-atomization narrowing is in the form of a hemispherical cavity slit by a slot;
- the spraying nozzle comprises a spraying member defining the spraying orifice, wherein the spraying member comprises, a cavity going from upstream to downstream and with a cross-section that decreases downstream, followed by a channel with a substantially constant cross-section that fluidly connects the cavity with the spraying orifice, while the pre-atomization narrowing opens into the cavity;
- the pre-atomization insert comprises a base and, protruding axially from the base, a finger having a free end opposite the base, while the free end defines the pre-atomization narrowing, and the finger is substantially and integrally housed in the cavity of the spraying member;
- the base has a cross-section that is complementary to the cross-section of the duct;
- the spraying member has an upstream face into which the cavity opens, while the upstream face defines an annular shoulder around the cavity, and wherein the base abuts the annular shoulder;

the pre-atomization narrowing opens at a distance from the channel at less than half the axial length of the cavity;

the spraying member is constituted by a spraying insert housed at least partly in the duct; and the ratio of the diameter of the spraying orifice to the diameter of the pre-atomization narrowing is between 0.5 and 0.8.

The invention also relates to a spraying head of the aforementioned type, wherein the spraying nozzle is constituted by a nozzle as defined above.

According to a particular embodiment of the invention, the spraying head also has the following characteristic:

the ring has an upstream end connected to a body of the spraying device and a downstream face facing away from the upstream end, and defining at least one rectilinear air channel that is intended to receive a compressed gas and opens into the downstream face, wherein the air channel is oriented in a convergent direction.

The invention further relates to a spraying gun comprising a spraying head as defined above.

The invention further relates to a spraying installation of the aforementioned type, wherein the spraying head is constituted by a head as defined above.

According to particular embodiments of the invention, the spraying installation also has one or more of the following characteristics, taken in isolation or according to any technically feasible combination:

the source of the product to be sprayed is capable of supplying the product to be sprayed with a pressure greater than 20 bars, advantageously greater than 100 bars, and the source of the product to be sprayed is capable of supplying the product to be sprayed with a pressure of between 20 and 300 bars, advantageously between 20 and 150 bars.

The invention also relates to a spraying process of the aforementioned type, wherein the spraying nozzle is constituted by a nozzle as defined above.

According to particular embodiments of the invention, the spraying process also has one or more of the following characteristics, taken alone or in any technically feasible combination:

the coating product is supplied to the nozzle at a pressure greater than 20 bar, advantageously greater than 100 bar, and the coating product is supplied to the nozzle at a pressure between 20 and 300 bar, advantageously between 20 and 150 bar.

BRIEF DESCRIPTION OF THE DRAWINGS

Other features and advantages of the invention will become apparent upon reading the description which follows, given solely by way of example and with reference to the drawings, wherein.

DETAILED DESCRIPTION

Figure 1:
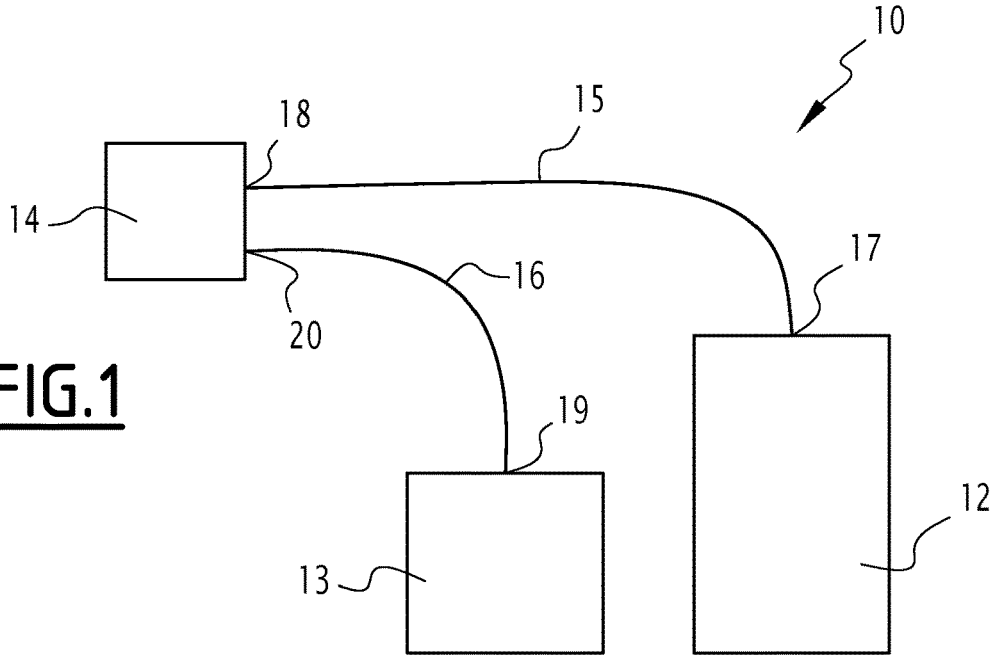
FIG. 1 shows a schematic view of a spraying installation according to the invention.

The spraying installation 10 shown in FIG. 1 comprises, in a known manner, a source 12 of coating product, a supply 13 of compressed gas, an applicator 14 for applying the coating product to a surface to be coated, a first fluidic connection 15 that fluidly connects the source 12 to the applicator 14, and a second fluidic connection 16 that fluidly connects the supply 13 to the applicator 14. The coating product is advantageously constituted by a fluid, for example by a paint, a dye, a glue, or a putty, typically having a viscosity of between 20 mPa·s and 500 mPa·s.

In the following, the orientation terms "upstream" and "downstream" refer to the direction of flow of the coating product in the installation 10, wherein the coating product flows from upstream to downstream.

The source 12 is designed to supply the coating product at an outlet pressure of between 20 and 300 bar, in particular between 20 and 150 bar, and advantageously between 20 and 80 bar. For this purpose, the source 12 typically comprises a coating product reservoir (not shown), and a pump (not shown) to pump the coating product into the reservoir and discharge it to the fluidic connection 16 at the outlet pressure.

The supply 13 is designed to supply a gas, typically compressed air, preferably at a pressure of between 0.2 bar and 6 bar, advantageously between 0.2 bar and 2 bar. For this purpose, the supply 13 is for example constituted by an air compressor.

The first fluidic connection 15 fluidly connects an outlet 17 of the source 12 to a first inlet 18 of the applicator 14. It is typically constituted by a flexible pipe.

The second fluidic connection 16 fluidly connects an outlet 19 of the supply 13 to a second inlet 20 of the applicator 14. It is typically constituted by a flexible pipe.

Figure 2:
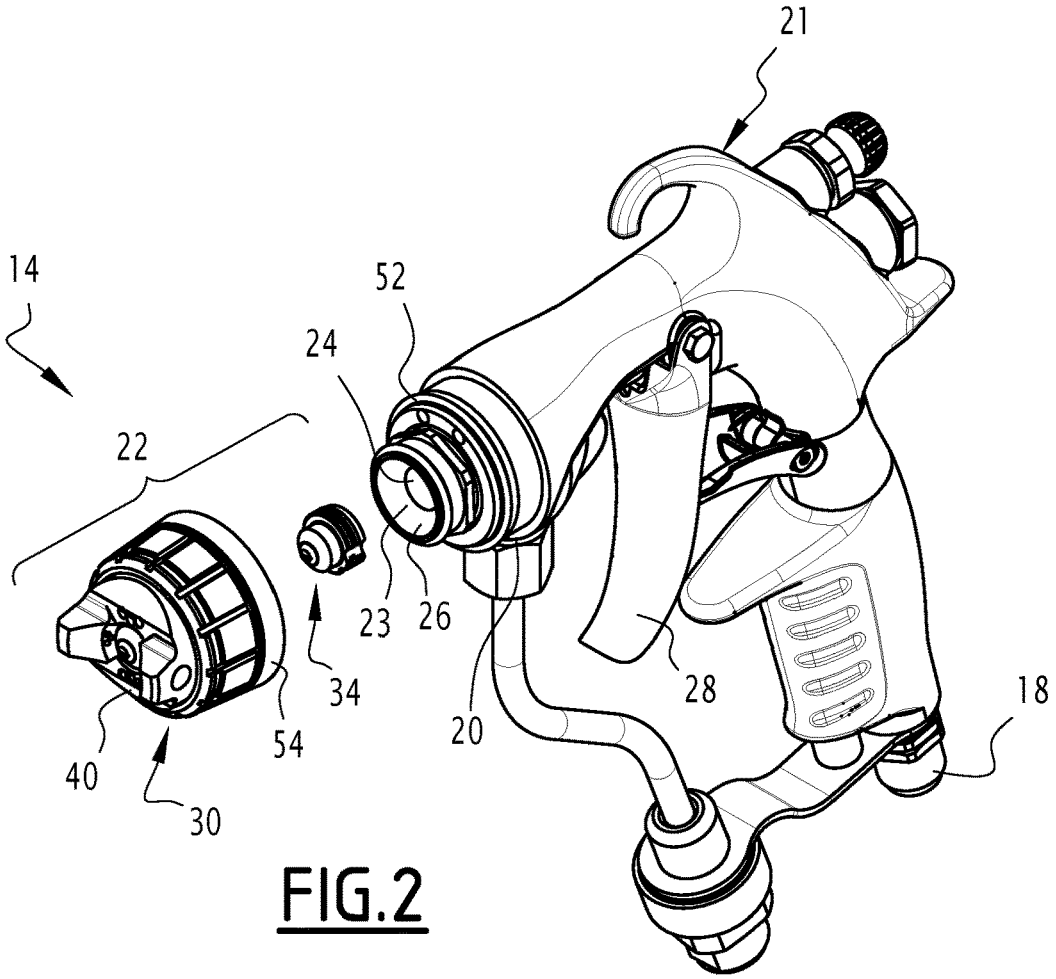
FIG. 2 shows an exploded perspective view, i.e. a three-quarters front view, of an applicator of the spraying installation of FIG. 1.

Referring to FIG. 2, the applicator 14 comprises a body 21 and a spraying head 22 mounted on the body 20.

The body 21 carries the first inlet 18 of the applicator 14 and comprises a tube 23 internally defining a duct (not shown) that fluidly connects the inlet 18 to a coating product outlet 24 of the body 21, wherein the orifice 24 defines the end of the tube 23.

The body 21 also comprises the second inlet 20 and internally defines a cavity (not shown) that fluidly connects the inlet 20 to a compressed gas outlet orifice 26 outside the body 21. The orifice 26 is arranged concentrically around the orifice 24 in the example shown.

The applicator 14 is constituted by a spraying gun in the example shown. The body 21 is shaped like a gun stock and carries a trigger 28 designed to actuate a valve (not shown) and moved relative to the body 21 between a position at rest, in which the valve closes the fluid connections between the inlet orifice 18 and the outlet orifice 24, 26, and an actuated position, where the valve releases the fluidic connections.

The spraying gun 14 is typically a manual spraying gun. Alternatively, the spraying gun 14 may be an automatic spraying gun.

Figure 3:
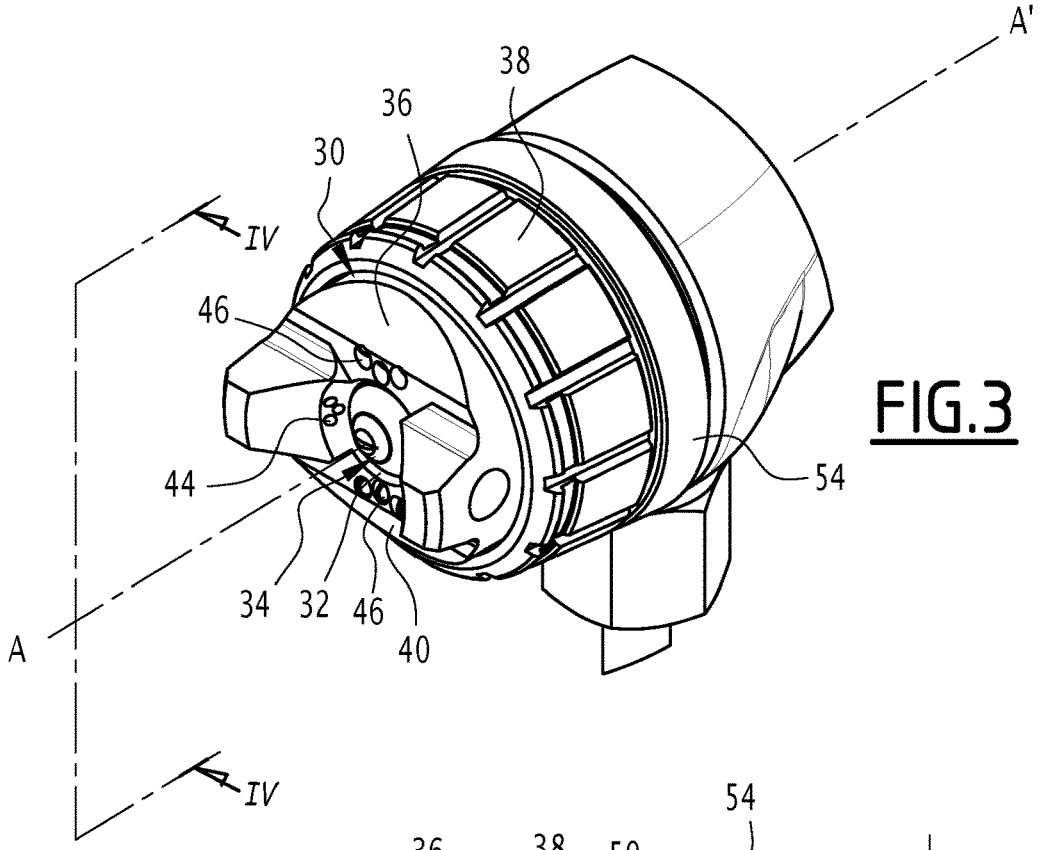
FIG. 3 shows a perspective view, i.e. a three-quarters front view, of a spraying head of the applicator of FIG. 2.

With reference to FIG. 3, the spraying head 22 comprises an annular ring 30 having a central orifice 32, and a spraying nozzle 34 housed in the central orifice 32.

The annular ring 30 is centered on an axis A-A'. It comprises an annular body defining the central orifice and a skirt 38 mounted to rotate about the axis A-A' relative to the body.

Figure 4:
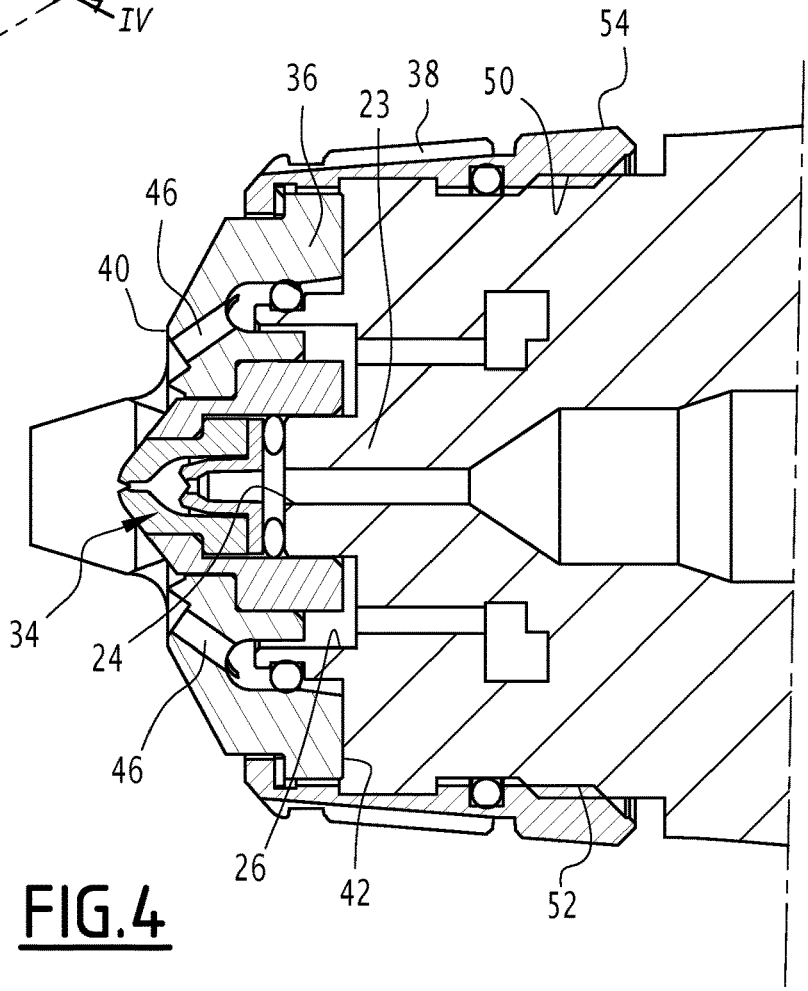
FIG. 4 shows a longitudinal sectional view of the spraying head of FIG. 3, wherein the sectional plane is represented by plane IV-IV in FIG. 3.

As seen in FIG. 4, the body 36 has a downstream face 40, facing away from the body 21, and an upstream face 42 facing the body 21. The body 36 further defines a plurality of air channels 44, 46 (FIG. 3), which are rectilinear and open into the upstream face 42 and downstream face 40, and wherein each air channel 44, 46 is oriented in a convergent direction, i.e. cutting the axis A-A'.

The spraying head 22 is mounted on the body 21 so that the air channels 44, 46 are fluidly connected to the outlet orifice 26. Thus, the air channels 44, 46 are fluidly connected to the source 13 of compressed gas.

The air channels 44, 46 comprise, in particular, first air channels 44, which converge at the nozzle 34, and second air channels 46, which converge downstream of the nozzle 34.

The skirt 38 protrudes upstream relative to the body 36. It has an internal thread 50 that is designed to interact with the complementary external thread 52 formed on the body 21 in order to be screwed on the body 21. It defines an upstream end 54 for connection of the ring 30 to the body 21. The downstream face 40 is oriented opposite this upstream end 54.

Figure 5:
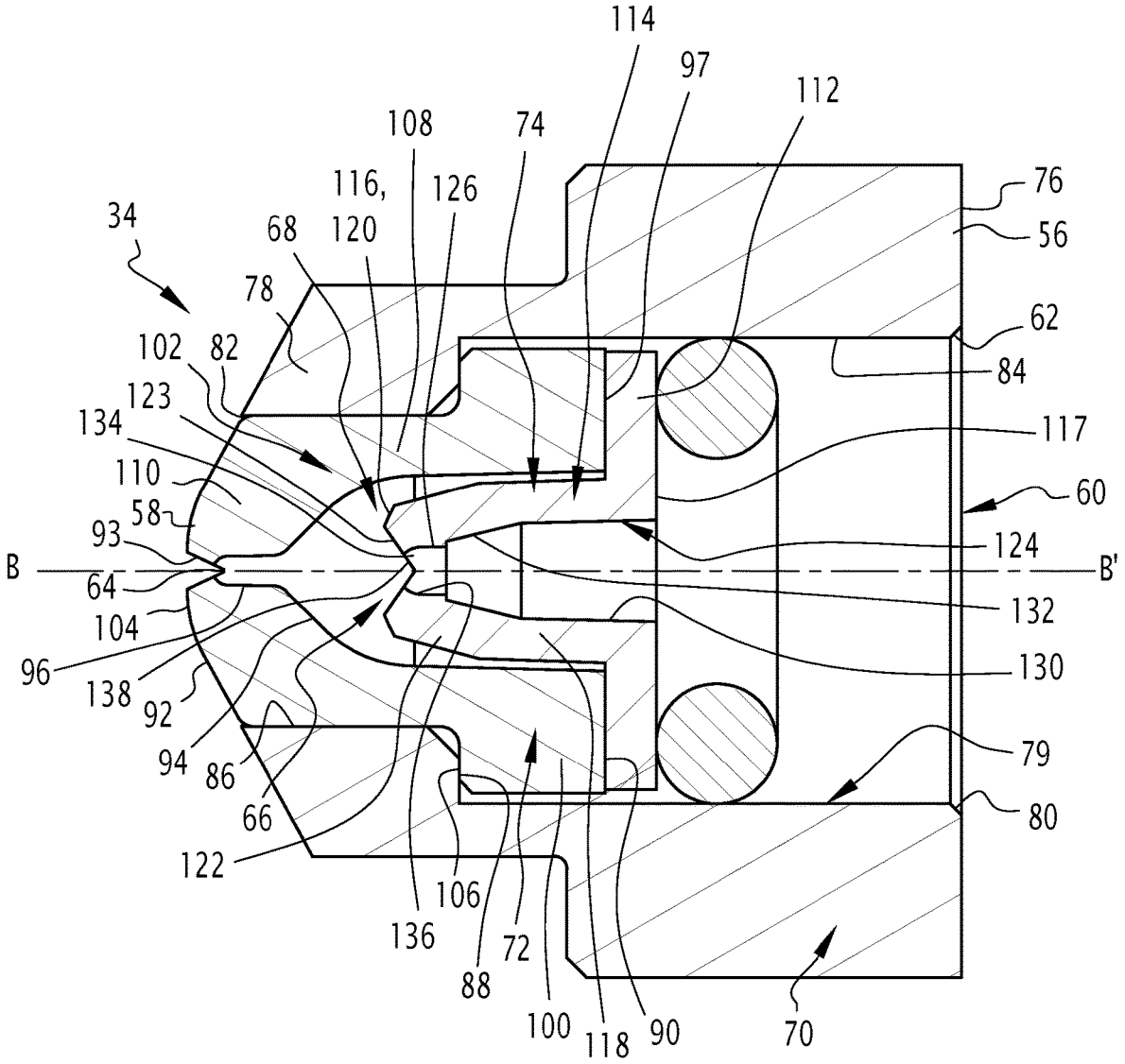
FIG. 5 shows a longitudinal sectional view of a spraying nozzle of the spraying head of FIG. 3.

Referring to FIG. 5, the spraying nozzle 34 has an upstream end 56 facing the body 21 and a downstream end 58 facing away from the body 21. The nozzle 34 further defines a passage 60 for the circulation of the coating product through the nozzle 34, wherein the passage 60 opens to the outside from the nozzle 34 through a wide connection orifice 62 at the upstream end 56 and through a narrow spraying orifice 64 at the downstream end 58, and is able to spray the coating product. For this purpose, the spraying orifice 64 typically has a diameter that is substantially between 0.3 mm and 1.15 mm.

The outside diameter of the nozzle 34 is, for its part, preferably less than 15 mm.

The connection orifice 62 is fluidly connected to the outlet orifice 24 of the body 21. For this purpose, the tube 23 is engaged in the passage 60 through the connection orifice 62.

Thus, the connection orifice 62 is fluidly connected to the coating product source 12.

According to the invention, the passage 60 has, between the connection orifice 62 and the spraying orifice 64, at least one pre-atomization narrowing 66 that is designed to atomize the product, wherein the, or each, narrowing 66 is followed by a broadening 68 downstream of the narrowing 66.

This pre-atomization narrowing 66 makes it possible to obtain a finer spray at the outlet of the nozzle 34, and to lower the supply pressure of the coating product nozzle 34 without impairing the homogeneity of the product jet at the outlet of the nozzle 34.

In the example shown, the nozzle 34 comprises, in particular, a tubular body 70, a spraying member 72, and a pre-atomization insert 74.

The body 70 is oriented in an axial direction B-B', i.e. the axial direction B-B' forms the axis of the body 70. The body 70 has, in particular, a cylindrical surface of revolution about the axis B-B'.

The nozzle 34 is, in particular, arranged coaxially with the ring 30. Thus, the axis B-B' coincides with the axis A-A'.

The body 70 has a first axial end 76 defining the upstream end 56 of the nozzle 34, and a second axial end 78 opposite the first axial end 76. The first axial end 76 is, in particular, flat and oriented transversely to the axial direction B-B'. The second axial end 78 is, in particular, frustoconical centered on the axis B-B'.

The body 70 internally defines a through-duct 79 opening into the first axial end 76 through a first opening 80, and into the second axial end 78 through a second opening 82, wherein the first opening 80 constitutes the connection 62 in the example shown.

The second opening 82 is, in particular, narrower than the first opening 80.

The through-duct 79 has a first section 84 of large diameter and a second section 86 of small diameter. The first section 84 opens to the outside of the body 70 through the first opening 80, while the second section 86 opens to the outside of the body 70 through the second opening 82.

The first section 84 has substantially the same diameter as the first opening 80. The second section 86 has substantially the same diameter as the second opening 82.

The first and second sections 84, 86 are joined to one another and the body 70 defines, at the interface between the first and second sections 84, 86, a radial shoulder 88 oriented towards the first opening 80. This shoulder 88 is, in particular, substantially flat and oriented transversely to the axis B-B'.

The spraying member 72 has an upstream face 90, housed in the duct 79, and a downstream face 92, opposite the upstream face 90 and arranged outside the body 70.

The upstream face 90 is substantially flat and is arranged substantially transversely to the axis B-B'. It has a diameter substantially equal to the diameter of the first section 84 of the duct 79.

The downstream face 92 is in the form of a dome centered on the axis B-B' and split with a slot 93 that is perpendicular to the axis B-B'. It is flush with the second axial end 78 of the body 70 on its periphery.

The slot 93 has lips which form between them an angle typically between 5° and 150°, preferably between 20° and 110°.

The spraying member 72 defines the spraying orifice 64.

The spraying member 72 further comprises, going from upstream to downstream, a cavity 94 with a cross-section that decreases downstream, followed by a channel 96 with substantially constant cross-section and that fluidly connects the cavity 94 with the spraying orifice 64.

The cavity 94 opens into the upstream face 90, while the upstream face 90 defines an annular shoulder 97 around the cavity 94 facing upstream.

The pre-atomization narrowing 66 opens into the cavity 94, wherein the cavity 94 defines the broadening 68 downstream of the narrowing 66.

The cavity 94 has, in the example shown, a bell shape.

The spraying orifice 64 is formed by a narrowing that terminates the channel 96 and is split by the slot 93. This narrowing is, in particular, in the form of a dome. The diameter of the spraying orifice 64 is defined as the major axis of the ellipse formed by the intersection of the slot 93 with the narrowing.

The spraying member 72 is, in particular, constituted by a spraying insert attached to the body 70 and housed partly in the duct 79.

This insert comprises a base 100 and, protruding axially along the axis B-B' from the base 100, a finger 102 having a free end 104 opposite the base 100, wherein the free end 104 defines the spraying orifice 64.

The base 100 is integrally housed in the first section 84 of the duct 79. It has a cross-section that is substantially complementary to that of the first section 84 and defines the upstream face 90. It also defines a radial shoulder 106 that is opposite the upstream face 90 and abuts the shoulder 88 of the body 70.

The base 100 preferably has an axial thickness of less than 4 mm. In particular, it is formed by a substantially flat plate that is orthogonal to the finger 102.

The finger 102 comprises a first cylindrical segment 108 and a second section 110 in the form of a dome.

The first section 108 is attached to the base 100. It is integrally housed in the second section 86 of the duct 79. It has a cross-section that is substantially equal to that of the second section 86.

The second section 110 is arranged outside the duct 79. It defines the free end 104 and the downstream face 92.

The pre-atomization insert 74 is attached to the body 70 while being housed in the duct 79, and defines the pre-atomization narrowing 66.

The pre-atomization insert 74 comprises a base 112 and, protruding axially along the axis B-B' from the base 112, a finger 114 having a free end 116 opposite the base 112, wherein the free end 116 defines the pre-atomization narrowing 66.

The base 112 is integrally housed in the first section 84 of the duct 79. It has a cross-section that is substantially complementary to that of the first section 84. It bears against the annular shoulder 97.

The base 112 also defines a downstream face 117 of the pre-atomization insert 74, oriented downstream and opposite to the annular shoulder 97.

Figure 6:
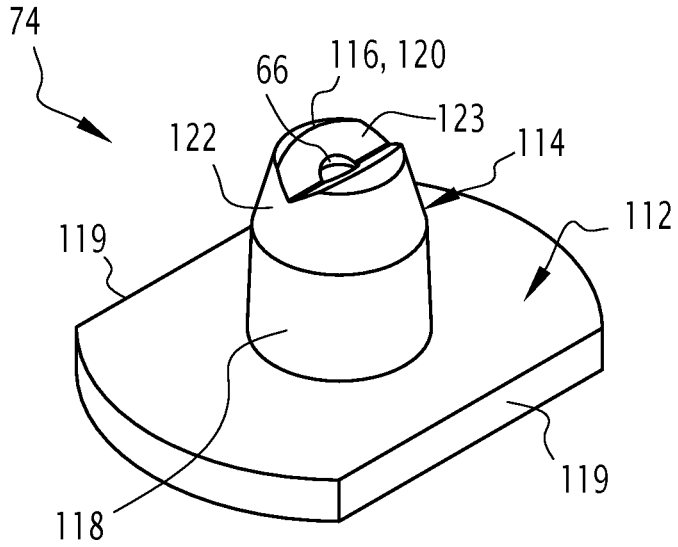
FIG. 6 shows a perspective view of a pre-atomization insert of the spraying nozzle of FIG. 5.
Figure 7:
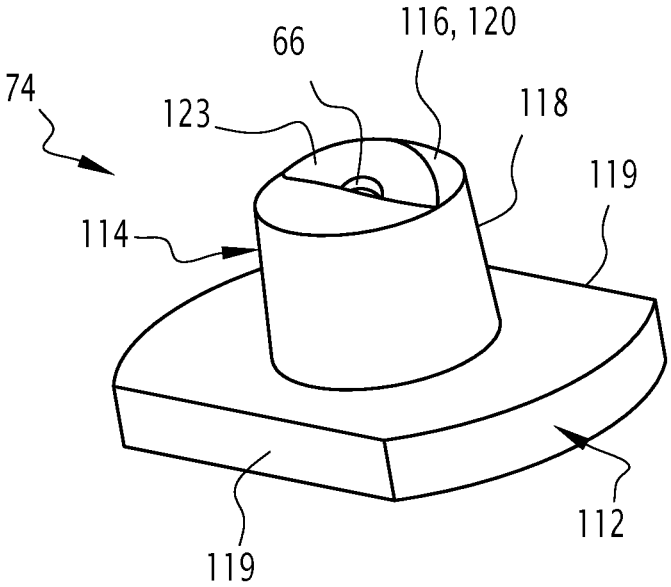
FIG. 7 shows a perspective view of a variant of the pre-atomization insert of FIG. 6.

In addition, as may be seen in FIGS. 6 and 7, the base 112 has at least one, in particular two, flat surfaces 119, which prevent(s) rotation of the insert 74 with respect to the body 70.

The finger 114 is housed substantially completely in the cavity 94.

The finger 114 comprises a first section 118 for connection to the base 112, and a second section 120 constituted by the free end 116. In a first variant of the insert 74, shown in FIGS. 5 and 6, it also comprises an intermediate section 122 between the first and second sections 118, 120.

Figure 8:
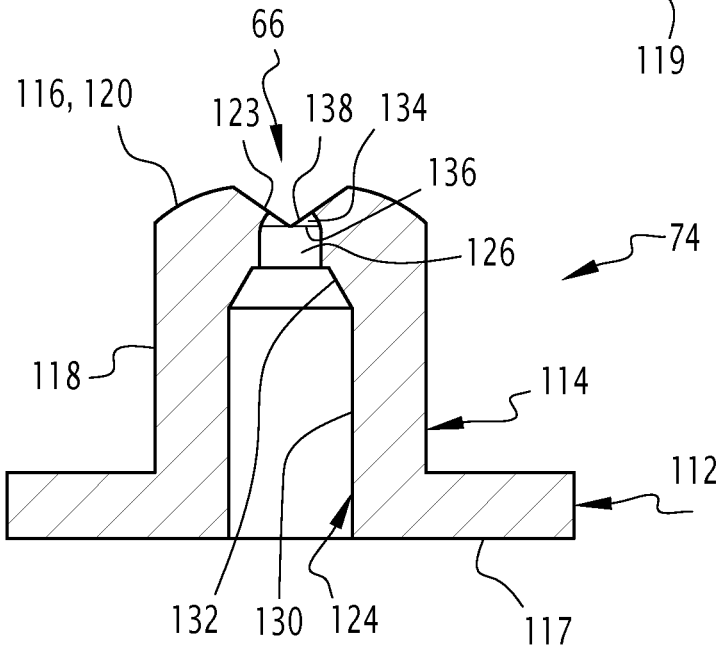
FIG. 8 shows a longitudinal sectional view of the pre-atomization insert of FIG. 7.

The first section 118 is cylindrical. In the first variant, it extends from the base 112 to the intermediate section 122. In a second variant, shown in FIGS. 7 and 8, it extends from the base 112 to the free end 116.

The free end 116 is in the form of a dome that is slit by a slot 123 that is perpendicular to the axis B-B'. It is housed in the cavity 94 and is arranged so that the pre-atomization narrowing 66 opens at a distance from the channel 96 at less than half the axial length of the cavity 94.

The slot 123 has lips which form between them an angle typically between 5° and 150°, preferably between 20° and 110°.

The intermediate section 122, when it exists, has a frustoconical shape and extends from the first section 118 to the second section 120. In addition, the slot 123 extends into the intermediate section 122.

The pre-atomization insert 74 internally defines, going from upstream to downstream, a cavity 124 with a cross-section that decreases downstream, followed by a channel 126 of substantially constant cross-section and that fluidly connects the cavity 124 to the pre-atomization narrowing 66.

The cavity 124 opens into the downstream face 117. It has, in the example shown, a cylindrical downstream section 130 opening into the downstream face 117, and a frustoconical upstream section 132.

The pre-atomization narrowing 66 is, in the example shown, formed by a hemispherical cavity 134 having a base 136 that opens into the channel 126 and a top 138, opposite the base 136, that is split by the slot 123. It has a diameter that is smaller than the cavity 94 of the spraying member 72, wherein this diameter is defined as being the major axis of the ellipse formed by the intersection of the slot 123 with the hemispherical cavity 134.

This specific form of the pre-atomization narrowing 66 makes it possible to obtain a finer spray and to further lower the supply pressure of the coating product nozzle 34 without impairing the homogeneity of the product jet leaving the nozzle 34.

The diameter of the pre-atomization narrowing 66 is preferably between 0.3 mm and 1.15 mm and greater than or equal to the diameter of the spraying orifice 64. In particular, the diameter of the pre-atomization narrowing 66 is such that the ratio of the diameter of the spraying orifice 64 to the diameter of the pre-atomization narrowing 66 is between 0.5 and 1.0.

This ratio of diameters reinforces the smoothness of the spray and makes it possible to increasingly lower the supply pressure of the coating product nozzle 34 without impairing the homogeneity of the product jet at the outlet of the nozzle 34.

The passage 60 is thus successively formed, going from upstream to downstream, by the cavity 124, followed by the channel 126, then the pre-atomization narrowing 66, before a downstream part of the cavity 94, followed by the channel 96 and finally, the spraying orifice 64.

A method of spraying coating product by means of the installation 10 will now be described.

First, the coating product and compressed gas sources 12, 13 are activated. The inlets 18, 20 of the body 21 are then supplied with coating product and pressurized gas.

Then, a user actuates the trigger 28. This has the effect of respectively bringing the inlets 18, 20 into fluid communication with the outlets 24, 26. The spraying nozzle 34 is then supplied coating product through its connection orifice 62, wherein the coating product is at a pressure between 20 and 300 bar, in particular between 20 and 150 bar, and advantageously between 20 and 80 bar. Simultaneously, the air channels 44, 46 are fed with gas under pressure.

Upon coming under pressure, the coating product is atomized a first time as it passes through the pre-atomization narrowing 66. It then disperses in the form of droplets in the downstream part of the cavity 94, before entering the channel 96. and then being atomized a second time as it passes through the spraying orifice 64. The coating product then disperses in the form of droplets in the space at the outlet of the nozzle 34. This dispersion is increased by virtue of the compressed gas blown by the channels 44, 46 and which strikes these droplets to burst them.

In this way, despite the relatively low coating product supply pressure, an excellent dispersion of the coating product is obtained, similar to that which may usually be observed in mixed spraying with conventional supply pressures.

By virtue of the invention described above, a quality of finish and a transfer rate similar to those usually encountered in mixed spraying are thus obtained, with, however, a reduced supply pressure of the coating product.

In addition, the compactness of the pre-atomization insert 74 makes it possible to use the spraying insert 72 and the ring 30 for the body 70 of the nozzle 34, that are the same as those usually used for mixed spraying. It is thus possible to retrofit existing spraying installations very easily and inexpensively.

Moreover, the compactness of the pre-atomization insert 74 makes it possible to minimize the dead volumes and, thus, avoids unwanted flows when the trigger 28 is released, in particular when using very fluid products such as dyes or top-coat paints, for example.

According to one variant (not shown) of the invention, the installation 10 does not include a source of compressed gas fluidly connected to the applicator 14. The spraying of the coating product is then done without air. In this case, the source 12 of coating product is capable of supplying the coating product at a pressure greater than 20 bar, preferably greater than 100 bar, while the coating product is supplied at such a pressure during the spraying process.

As in the case of mixed spraying, the invention makes it possible here to obtain a quality of finish and a transfer rate in airless spraying that are similar to those usually obtained, but with a reduced supply pressure of the coating product.

In addition, the compactness of the pre-atomization insert 74 makes it possible to use the spraying insert 72 and the ring 30 for the body 70 of the nozzle 34, that are the same as those usually used for airless spraying. It is thus possible to retrofit existing spray installations very easily and inexpensively.

Finally, the compactness of the pre-atomization insert 74 makes it possible to minimize dead volumes and thus avoid unwanted flows when the trigger 28 is released, in particular when using very fluid products such as dyes or top-coat paints, for example.

The invention claimed is:

1. A nozzle for spraying a coating product, the nozzle comprising:

a tubular body delimiting a connecting orifice to an outside of the nozzle at an upstream end of the nozzle, the tubular body oriented in an axial direction and delimiting internally a through-duct opening in a first axial end of the tubular body through the connecting orifice;

a spraying member delimiting a spraying orifice at a downstream end of the nozzle, said connecting orifice being wider than the spraying orifice, the spraying member delimiting, going from upstream to downstream, a cavity with a cross-section that decreases downstream, followed by a channel with a substantially constant cross-section that fluidly connects the cavity with the spraying orifice, and the nozzle delimiting a passage for circulation of the coating product through the nozzle, the passage opening through said connecting orifice at the upstream end, and through said spraying orifice at the downstream end; and a pre-atomization insert housed in the through-duct of said tubular body, the pre-atomization insert comprising:

a base; and a finger protruding axially from said base and having a free end opposite said base, the finger being substantially integrally housed in the cavity of said spraying member, the free end of the finger delimiting a pre-atomization narrowing of the passage between said connecting orifice and said spraying orifice, the pre-atomization narrowing being formed by a hemispherical cavity slit by a slot, the pre-atomization narrowing being capable of atomizing the coating product, the pre-atomization narrowing opening into the cavity of said spraying member, the passage broadening at the cavity downstream of the pre-atomization narrowing, the passage thus comprising, from upstream to downstream:

said connecting orifice;

the through-duct;

the pre-atomizing narrowing;

the cavity;

the channel; and said spraying orifice.

2. The nozzle according to claim 1, wherein said base has a cross-section that is complementary to a cross-section of the through-duct.

3. The nozzle according to claim 1, wherein said spraying member comprises an upstream face into which the cavity opens, the upstream face comprising an annular shoulder around the cavity, and wherein said base bears against said annular shoulder.

4. The nozzle according to claim 1, wherein the pre-atomization narrowing opens at a distance from the channel that is less than half an axial length of the cavity.

5. The nozzle according to claim 1, wherein an intersection of the slot with the hemispherical cavity forms an ellipse having a diameter of the pre-atomization narrowing as a major axis, the ratio of a diameter of the spraying orifice to the diameter of the pre-atomization narrowing being between 0.5 and 0.8.

6. A method for spraying, comprising:

providing the nozzle according to claim 1, for spraying the coating product;

supplying the coating product to the nozzle, through its connecting orifice, at a pressure greater than 20 bar;

atomizing the coating product during passage of the coating product through the pre-atomization narrowing; and further atomizing the coating product during passage of the coating product through the spraying orifice.

7. The method according to claim 6, wherein said supplying supplies the coating product at a pressure between 20 and 300 bar.

8. A spraying head for a coating product spraying device, comprising:

an annular ring comprising a central orifice; and a nozzle housed in said central orifice and substantially coaxial with said annular ring, the nozzle comprising:

a tubular body delimiting a connecting orifice to an outside of the nozzle at an upstream end of the nozzle, the tubular body oriented in an axial direction and delimiting internally a through-duct opening in a first axial end of the tubular body through the connecting orifice;

a spraying member delimiting a spraying orifice at a downstream end of the nozzle, the connecting orifice being wider than the spraying orifice, the spraying member delimiting, going from upstream to downstream, a cavity with a cross-section that decreases downstream, followed by a channel with a substantially constant cross-section that fluidly connects the cavity with the spraying orifice, and the nozzle delimiting a passage for circulation of the coating product through the nozzle, the passage opening through the connecting orifice at the upstream end, and through the spraying orifice at the downstream end; and a pre-atomization insert housed in the through-duct of said tubular body, the pre-atomization insert comprising:

a base; and a finger protruding axially from said base and having a free end opposite said base, the finger being substantially integrally housed in the cavity of said spraying member, the free end of the finger delimiting a pre-atomization narrowing of the passage between the connecting orifice and the spraying orifice, the pre-atomization narrowing being formed by a hemispherical cavity slit by a slot, the pre-atomization narrowing being capable of atomizing the coating product, the pre-atomization narrowing opening into the cavity of said spraying member, the passage broadening at the cavity downstream of the pre-atomization narrowing, the passage thus comprising, from upstream to downstream:

the connecting orifice;

the through-duct;

the pre-atomizing narrowing;

the cavity;

the channel; and the spraying orifice.

9. The spraying head according to claim 8, wherein said annular ring has an upstream end for connection to a body of an applicator of the coating product spraying device, and a downstream face oriented opposite the upstream end, said annular ring delimiting at least one rectilinear air channel that receives a compressed gas, the at least one rectangular channel opening into the downstream face, and said annular ring having a central axis, wherein each of the at least one rectilinear air channel is oriented in a given direction, each given direction converging from upstream to downstream towards the central axis.

10. A spraying gun comprising a spraying head, the spraying head comprising:

an annular ring comprising a central orifice; and a nozzle housed in said central orifice and substantially coaxial with said annular ring, the nozzle comprising:

a tubular body delimiting a connecting orifice to an outside of the nozzle at an upstream end of the nozzle, the tubular body oriented in an axial direction and delimiting internally a through-duct opening in a first axial end of the tubular body through the connecting orifice;

a spraying member delimiting a spraying orifice at a downstream end of the nozzle, the connecting orifice being wider than the spraying orifice, the spraying member delimiting, going from upstream to downstream, a cavity with a cross-section that decreases downstream, followed by a channel with a substantially constant cross-section that fluidly connects the cavity with the spraying orifice, and the nozzle delimiting a passage for circulation of the coating product through the nozzle, the passage opening through the connecting orifice at the upstream end, and through the spraying orifice at the downstream end; and a pre-atomization insert housed in the through-duct of said tubular body, the pre-atomization insert comprising:

a base; and a finger protruding axially from said base and having a free end opposite said base, the finger being substantially integrally housed in the cavity of said spraying member, the free end of the finger delimiting a pre-atomization narrowing of the passage between the connecting orifice and the spraying orifice, the pre-atomization narrowing being formed by a hemispherical cavity slit by a slot, the pre-atomization narrowing being capable of atomizing the coating product, the pre-atomization narrowing opening into the cavity of said spraying member, the passage broadening at the cavity downstream of the pre-atomization narrowing, the passage thus comprising, from upstream to downstream:

said connecting orifice;

the through-duct;

the pre-atomizing narrowing;

the cavity;

the channel; and said spraying orifice.

11. A spraying installation comprising:

a source supplying a coating product; and a spraying head, comprising:

an annular ring comprising a central orifice; and a nozzle housed in the central orifice and substantially coaxial with said annular ring, the nozzle comprising:

a tubular body delimiting a connecting orifice to an outside of the nozzle at an upstream end of the nozzle, the tubular body oriented in an axial direction and delimiting internally a through-duct opening in a first axial end of the tubular body through the connecting orifice;

a spraying member delimiting a spraying orifice at a downstream end of the nozzle, the connecting orifice being wider than the spraying orifice, the spraying member delimiting, going from upstream to downstream, a cavity with a cross-section that decreases downstream, followed by a channel with a substantially constant cross-section that fluidly connects the cavity with the spraying orifice, and the nozzle delimiting a passage for circulation of the coating product through the nozzle, the passage opening through the connecting orifice at the upstream end, and through the spraying orifice at the downstream end; and a pre-atomization insert housed in the through-duct of said tubular body, the pre-atomization insert comprising:

a base; and a finger protruding axially from said base and having a free end opposite said base, the finger being substantially integrally housed in the cavity of said spraying member, the free end of the finger delimiting a pre-atomization narrowing of the passage between the connecting orifice and the spraying orifice, the pre-atomization narrowing being formed by a hemispherical cavity slit by a slot, the pre-atomization narrowing being capable of atomizing the coating product, the pre-atomization narrowing opening into the cavity of said spraying member, the passage broadening at the cavity downstream of the pre-atomization narrowing, the passage thus comprising, from upstream to downstream:

the connecting orifice;

the through-duct;

the pre-atomizing narrowing;

the cavity;

the channel; and the spraying orifice, wherein said source is able to supply the coating product at a pressure greater than 20 bar while being fluidly connected to the connecting orifice of said nozzle.

12. The spraying installation according to claim 11, further comprising a source supplying compressed gas, wherein said annular ring has an upstream end for connection to a body of an applicator of the coating product spraying device, and a downstream face oriented opposite the upstream end, said annular ring delimiting at least one rectilinear air channel that receives the compressed gas, the at least one rectangular channel opening into the downstream face, and said annular ring having a central axis, wherein each of the at least one rectilinear air channel is oriented in a given direction, each given direction converging from upstream to downstream towards the central axis, wherein said source supplying the coating product is capable of supplying the coating product at a pressure between 20 and 300 bar, and is fluidly connected to the connecting orifice of said nozzle, and wherein said source supplying compressed gas is fluidly connected to each rectilinear air channel of said annular ring.

* * * * *